US007513466B1

(12) United States Patent
Daily

(10) Patent No.: US 7,513,466 B1
(45) Date of Patent: Apr. 7, 2009

(54) PAINTBRUSH SUPPORT WITH PAINT STRAINING ABILITY

(76) Inventor: Kevin Daily, 10 Tiffin Pl., Bridgewater, NJ (US) 08807

( * ) Notice: Subject to any disclaimer, the term of this patent is extended or adjusted under 35 U.S.C. 154(b) by 0 days.

(21) Appl. No.: 11/974,963

(22) Filed: Oct. 17, 2007

Related U.S. Application Data

(60) Provisional application No. 60/829,889, filed on Oct. 18, 2006.

(51) Int. Cl.
*A46B 17/02* (2006.01)

(52) U.S. Cl. ..... 248/110

(58) Field of Classification Search ..... 248/110, 248/111, 112; 15/257.06; 220/697, 736
See application file for complete search history.

(56) References Cited

U.S. PATENT DOCUMENTS 2,639,835 A * 5/1953 Nelson ..... 220/697
4,721,225 A * 1/1988 Sobel ..... 220/736
4,969,617 A * 11/1990 Desjardins ..... 248/146
6,820,848 B1 * 11/2004 Adam ..... 248/213.2
7,118,078 B2 * 10/2006 Vukas ..... 248/110

FOREIGN PATENT DOCUMENTS

CH 598527 * 4/1978
CH 673883 * 12/1990

* cited by examiner

*Primary Examiner*—Ramon O Ramirez
(74) *Attorney, Agent, or Firm*—Goldstein Law Offices, P.C.

(57) ABSTRACT

A paintbrush support, for use in supporting a paintbrush having a bristle and handle, within a paint can having side walls, a top lip, and a bottom, the paint can holding a quantity of paint having a paint level. The paintbrush support has an outer ring defining a large central opening, and a support surface that is attached to the outer ring and spans the large central opening. The support surface is made of a mesh material and is convex downwardly, so that when the paintbrush support extends within the paint can near the paint level, the bristles can rest upon the support surface and remain within the quantity of paint, thereby staying moist while the handle rests against the top lip of the can—remaining dry.

5 Claims, 4 Drawing Sheets

PAINTBRUSH SUPPORT WITH PAINT STRAINING ABILITY

CROSS REFERENCES AND RELATED SUBJECT MATTER

This application is a continuation-in-part of provisional patent application Ser. No. 60/829,889, filed in the United States Patent Office on Oct. 18, 2006.

BACKGROUND OF THE INVENTION

The invention relates to a paintbrush support. More particularly, the invention relates to a device which attaches inside of a standard paint can, and supports a paint brush inside the can such that the handle remains above the surface of the paint. The device can also act as a strainer to filter debris from the paint.

Painting is perhaps the most common of all household maintenance tasks. Millions of do-it-yourselfers undertake painting their homes, apartments, and offices every year. In recent years, a great many innovations have helped save time, and eliminate mess-making potential for such painters. Despite these innovations, several aspects of painting remain clumsy, and in need of innovation.

Perhaps the most common painting problem is where to set down the paintbrush while painting. Once dipped in paint, the paintbrush will soil any surface it contacts. In addition, it is important to keep the bristles moist, or paint will dry on the brush, rendering it unusable. To compound the problem, it is equally important to keep the handle free of paint—lest the painter will soil his/her hands and likely transfer paint to other undesirable locations. Accordingly, the common practice of placing the paintbrush inside of the paint can fails to provide an appropriate solution.

Some other proposed solutions to the paintbrush storage problem are as follows:

U.S. Pat. No. 4,116,332 to Hartley illustrates a paintbrush holder that has a can connector and allows vertical adjustment to compensate for paint can level. In particular, Hartley sits on top of the rim of the paint can, and has a vertically adjustable clamp for holding the paint brush.

U.S. Pat. No. 4,721,225 to Sobel discloses a paintbrush holder for use with a paint container. Sobel supports the brush above the paint can, and has a mesh-like base, which allows paint to drain back into the can when the base is above the paint level.

U.S. Pat. No. 4,865,282 to Yonkman discloses a paint roller wiper and mesh paintbrush holder having a container rim attachment. Yonkman suspends from the lip of the container and provides a cage for holding and wiping the brush.

While these units may be suitable for the particular purpose employed, or for general use, they would not be as suitable for the purposes of the present invention as disclosed hereafter.

Another common painting problem is that debris often enters and contaminates the paint supply, rendering the paint unusable. This problem is especially acute at construction sites. Often simultaneously with painting one location, messy construction is taking place nearby. It is not uncommon for debris from nearby construction to end up in the paint. In addition, people commonly store paint for a long period of time to ensure that they have matching paint in the event of a repair. When paint is stored for an extended period of time, however, rust and other contaminants often end up in the paint—especially as the can begins to rust. Accordingly, even in a closed container of paint, debris and contaminants can accumulate. What is needed is an effective solution to prevent wasted paint, while still maintaining high paint quality.

Yet another common painting problem is from paint spills. Drop clothes and masking tape is insufficient to protect flooring, carpeting, walls, and trim from a spilled paint can. In addition, when the paint can is suddenly jarred, the paint can slosh and splash within the can, often resulting in a spray of paint leaving the can. What is needed is a solution that minimizes the impact from a spilled or jarred paint can.

SUMMARY OF THE INVENTION

It is an object of the invention to produce a paintbrush support that provides a convenient place to hold a paintbrush. Accordingly, the paintbrush support fits within a standard paint can, and provides a support surface which holds the paintbrush in a handy, ready to use position.

It is another object of the invention to provide a paintbrush support that keeps the paintbrush moist with paint while keeping the handle free of paint. Accordingly, the outer ring of the paint brush support adjusts in height within the paint can so that it rests just above the paint level, and the support surface is made of a fine mesh which allows the paint bristles to remain slightly within the paint while maintaining the handle well above the paint level.

It is a further object of the invention to provide a paintbrush support that is simple in construction, and yet is adjustable in height and firmly holds its position within the paint can. Accordingly, the outer ring of the paint brush support is made of a flexible material and is sized to provide an interference fit within the paint can to hold it securely in place while allowing the user to easily move the outer ring vertically within the can as the paint level changes. Alternatively, the outer ring can be constructed to float at the paint level, thereby automatically adjusting to the paint level and providing the same functionality.

It is a still further object of the invention to provide a paintbrush support that prevents debris from reaching the paint within the can and can also be used to remove debris from the paint. Accordingly the fine mesh of the support surface not only keeps external debris from reaching the paint, and keeps debris within the paint can from reaching the brush, but also can be used to clean a quantity of paint by pouring the paint through the support surface and into another container.

It is yet a further object of the invention to provide a paintbrush support that helps prevent paint spills. Accordingly, when the paint can tips over with the paintbrush support in place, the effect of a paint spill can be minimized—especially when the can is quickly "righted" by the user. In addition, the impact of splashing paint when the can is suddenly jarred is virtually eliminated.

The invention is a paintbrush support, for use in supporting a paintbrush having a bristle and handle, within a paint can having side walls, a top lip, and a bottom, the paint can holding a quantity of paint having a paint level. The paintbrush support has an outer ring defining a large central opening, and a support surface that is attached to the outer ring and spans the large central opening. The support surface is made of a mesh material and is convex downwardly, so that when the paintbrush support extends within the paint can near the paint level, the bristles can rest upon the support surface and remain within the quantity of paint, thereby staying moist while the handle rests against the top lip of the can—remaining dry.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
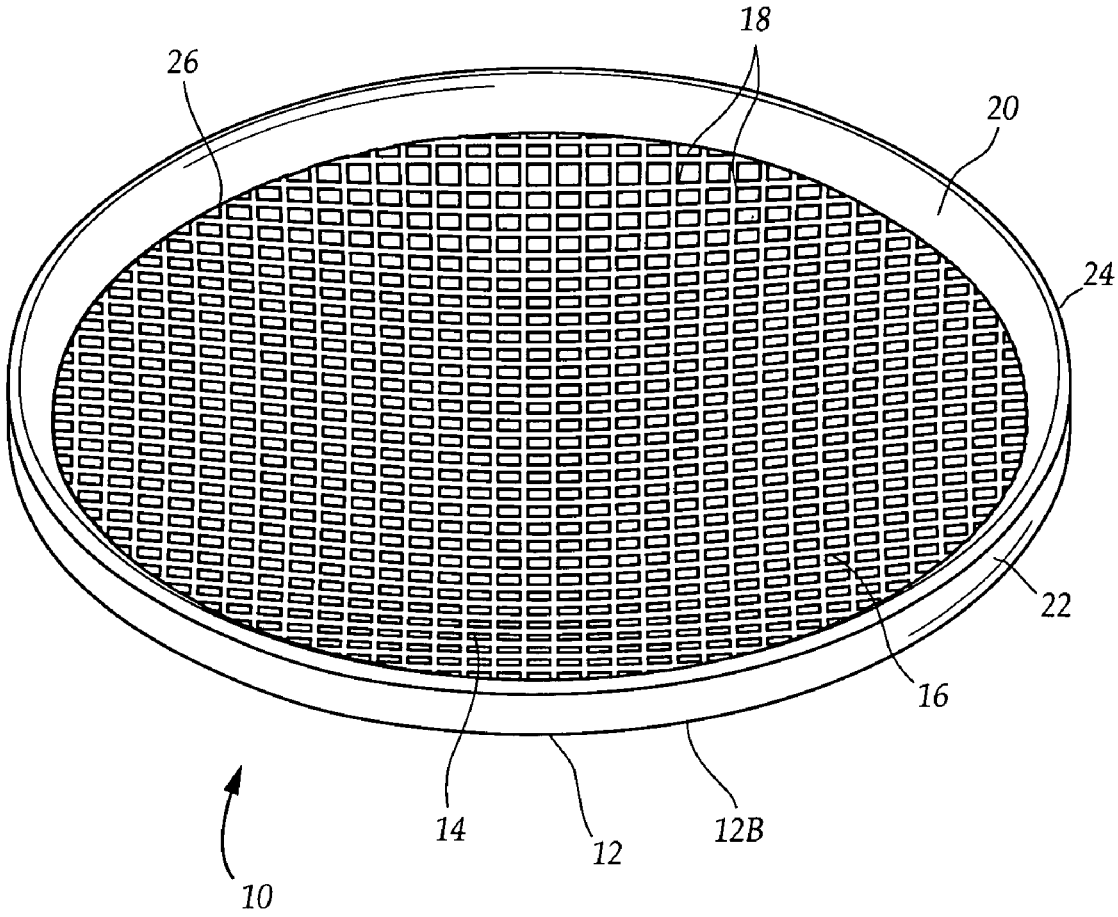
FIG. 1 is a diagrammatic perspective view, illustrating the present invention, per se.

FIG. 1 illustrates a paintbrush support 10 having an outer ring 12 and a support surface 14. The support surface 14 is made of a mesh material 16 having a plurality of openings 18. It should be noted that the granularity of the mesh material 14 or the size of its openings 18 cannot be extrapolated from the drawings. The scale of the mesh material 14 illustrated in the drawings should not be taken literally, as it is for the sake of line quality and clarity, and accordingly is exaggerated throughout the drawing figures.

The outer ring 12 is round and has an inner surface 20, an outer surface 22, and a bottom 12B. In the embodiment illustrated, the inner surface 20 and outer surface 22 meet at a peak 24. The outer ring 12 is made of a flexible material, such as plastic or rubber, allowing it to flex, especially at the outer surface 22. The outer ring 12 defines a large central opening 26, which is also round. The support surface 14 spans fully across the large central opening 26. The support surface 14 is attached to the outer ring 12 at the bottom 12B.

Figure 2:
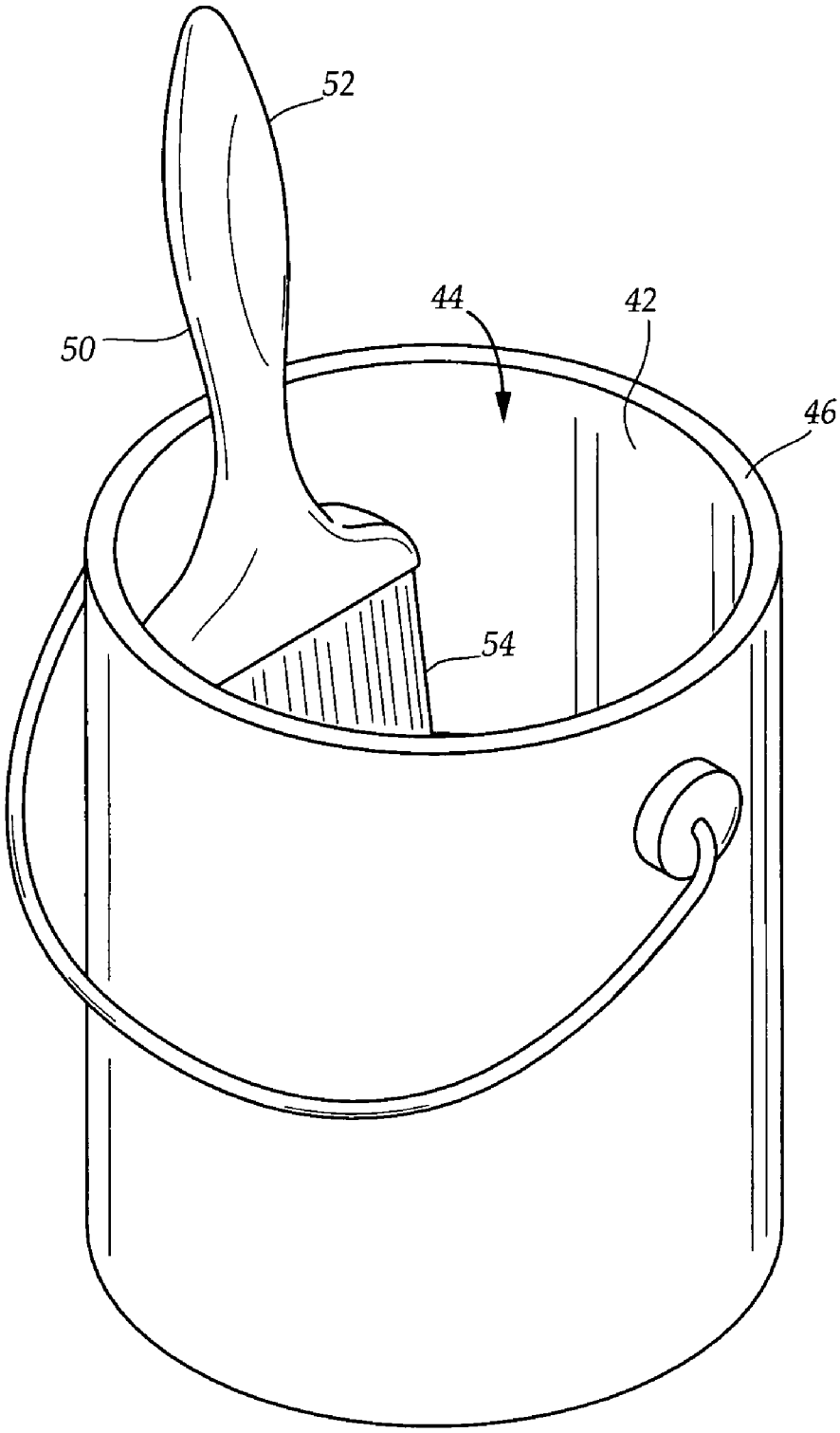
FIG. 2 is a diagrammatic perspective view, illustrating a standard paint can with the invention installed, supporting a brush, the present invention just beyond view.

Referring to FIG. 2, the paintbrush support is used in conjunction with a standard one gallon paint can 40 having substantially cylindrical side walls 42 defining an interior cavity 44 for containing a quantity of paint. The paint being a liquid, it naturally has a paint level—according to whatever quantity of paint remains in the can. The side walls 42 have a diameter, which is standardly 6⅝ inch. The side walls 42 have a top lip 46 and a bottom 48. The paintbrush support is also used in conjunction with a paintbrush 50, having a handle 52 at one end, and a plurality of bristles 54 at an opposite end.

Figure 3:
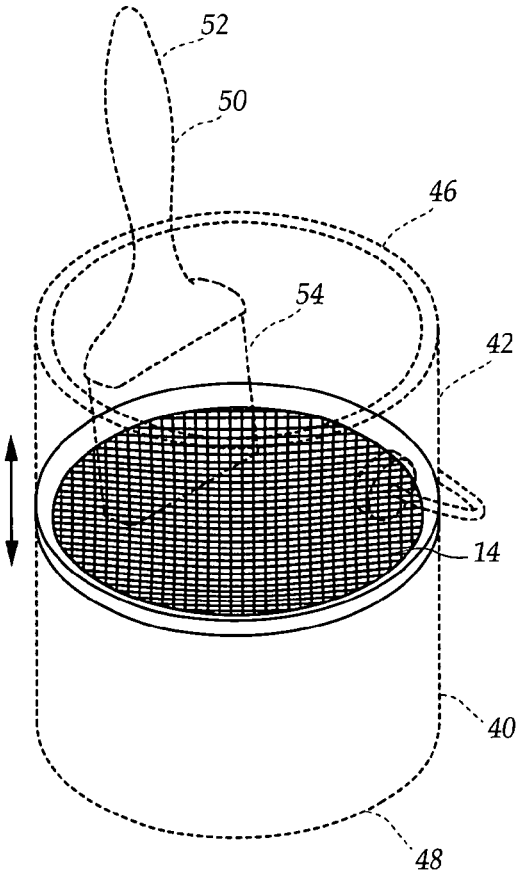
FIG. 3 is a diagrammatic perspective view, similar to FIG. 2, except wherein the paint can is illustrated in phantom, showing the invention within the can.
Figure 4:
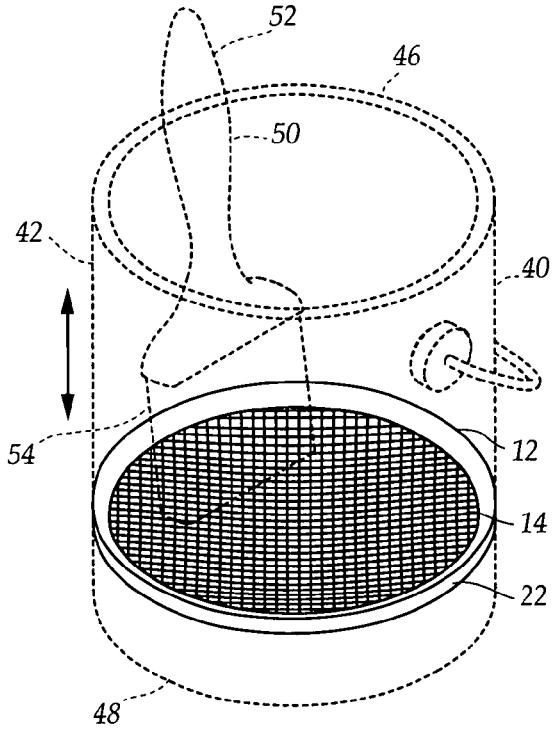
FIG. 4 is a diagrammatic perspective view, similar to FIG. 3, except wherein the invention is at a lower position within the paint can to follow the paint level as it decreases.

Referring to FIG. 3 and FIG. 4, the paintbrush support 10 is shown located within the can 40. In particular, the paintbrush support 10 is located substantially midway between the top lip 46 and bottom 48. The outer ring 12 is located at or slightly above the paint level. As the arrows in FIGS. 3 and 4 indicate, the outer ring 12 is moved upwardly or downwardly within the side walls 42 as the paint level in the can changes. The support surface 14 dips downwardly into the paint. Accordingly, as the paintbrush 50 rests upon the support surface 14, the bristles 54 remain within the paint, thereby staying moist. In addition, the handle 52 of the paintbrush 50 rests against the top lip 46, thereby staying dry.

The outer surface 22 of the outer ring 12 is substantially the same in diameter as the side walls 42 of the paint can 40. In a preferred diameter, the outer surface 22 of the outer ring 12 is actually slightly larger in diameter than the side walls 42 of the paint can, creating an interference fit, whereby the outer surface 22 must flex slightly to fit within the side walls 42 and thereby exerts a spring force against the side walls 42 which holds the outer ring 12 in place. A user manually moves the outer ring 12 downwardly as the quantity of paint is depleted and the paint level falls. This embodiment is preferred since it can help prevent spilled and splashed paint, and other mishaps. In particular, with the outer ring 12 secured to the side walls 42, if the paint can were to be jarred, causing the paint within to splash, it is unlikely that the splashing paint will actually leave the can. Due to the viscosity of the paint, the splashing paint will be substantially stopped from leaving the can by the support surface 14. The support surface 14 would be similarly effective in slowing a spill in the event of the paint can being tipped over—especially if the can is quickly righted by the user.

By a further embodiment of the invention, the outer surface 22 of the outer ring 12 is slightly smaller in diameter than the side walls 42, creating a clearance fit, allowing the outer ring 12 to move easily vertically within the side walls 42, yet being substantially stabilized horizontally by the near fit with the side walls. In such an embodiment, the outer ring 12 floats upon the surface of the paint and thereby moves upwardly and downwardly within the can automatically as the paint level changes.

Figure 5:
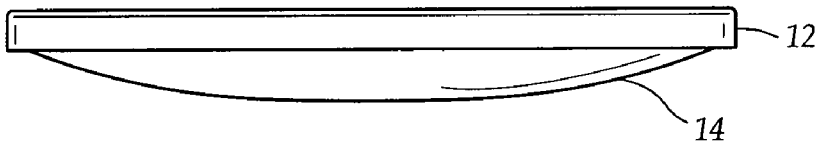
FIG. 5 is a side elevational view, showing just the invention, per se, with the support surface shown smooth for the sake of illustrative clarity.

FIG. 5 is a side elevational view, illustrating how the support surface 14 is semispherical, dipping below the outer ring 12, most dramatically at its center. In particular, it can be said that the support surface 14 is convex in the downward direction or concave in the upward direction.

Figure 6:
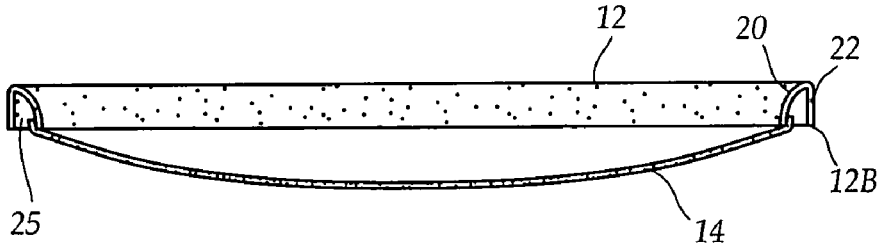
FIG. 6 is a side elevational view, similar to FIG. 5, with parts broken away, illustrating construction of the outer ring, and connection of the support surface thereto.

FIG. 6 is a cross sectional view, which illustrates the outer ring 12 and its interconnection with the support surface 14. In particular, in the embodiment shown, the support surface is attached to the inner surface 20 of the outer ring 12, at the bottom 12B, between the inner surface and outer surface. In addition, it should be noted that the inner surface 20 and outer surface 22 together create a ring shaped internal cavity 25, which holds a quantity of air. Accordingly, even if open at the bottom 12B (as in the embodiment shown), the outer ring 12 would nevertheless float upon the surface of the paint if so desired. And of course, whether the outer ring 12 actually floats upon the surface or remains fast to the side walls 42 depends on whether an interference fit or a clearance fit with the side walls 42 is created by the relative sizing of the outer ring 12.

In addition to remaining within the paint can 40 to support the paintbrush 50, the paintbrush support 10 can also function as a strainer to both remove debris from paint and prevent debris from reaching the paint. In particular, holding the outer ring 12 as a handle, a quantity of paint can be poured through the support surface 14 into another container. The small openings of the mesh material that comprises the support surface 14 effectively filters the paint—leaving debris upon the support surface 14 while the paint travels therethrough into the other container waiting below. In addition, when paint debris has already accumulated in the paint can, the support surface 14 of the paintbrush support 10 effectively prevents the paint from reaching the bristles of the paintbrush. It should also be clear that when used within the paint can 40 as previously described, the paintbrush support 12 also prevents external debris from reaching the paint, as it will be caught by the support surface.

In conclusion, herein is presented a paintbrush support which extends within a standard paint can and has a support surface which effectively supports a paintbrush. The mesh-like quality of the support surface also prevents debris from reaching the paint and can be used to filter debris from the paint. The invention is illustrated by example in the drawing figures, and throughout the written description. It should be understood that numerous variations are possible, while adhering to the inventive concept. Such variations are contemplated as being a part of the present invention.

What is claimed is:

1. A paintbrush support for use in supporting a paintbrush, having a handle at one end and bristles at an opposite end, within a paint can having a top lip, a bottom, and cylindrical side walls having a diameter, the paint can containing a quantity of paint having a paint level, comprising:

an outer ring, the outer ring round made of a flexible material, the outer ring defining a large central opening, the outer ring for extending within the paint can with the outer ring in close proximity to the side walls and substantially at the paint level, the outer ring is slightly larger in diameter than the diameter of the side walls thereby creating an interference fit between the outer ring and side walls that holds the outer ring in position against the side walls until moved by a user; and a support surface attached to the outer ring and spanning across the large central opening, the support surface made of a mesh material for allowing the bristles of the paintbrush to rest upon the support surface while the bristles are in communication with the quantity of paint through the support surface and while the handle rests against the top lip of the can, wherein the support surface extends convex downwardly between and beneath the outer ring so that it dips into the quantity of paint within the paint can when the outer ring is substantially at the paint level.

2. The paintbrush support as recited in claim 1, wherein the outer ring includes an outer surface, an inner surface, and a bottom, the outer surface and inner surface meet at a peak and define a cavity which is open at the bottom, the support surface is attached to the inner surface near the bottom and between the outer surface and inner surface.

3. A paintbrush support for use in supporting a paintbrush, having a handle at one end and bristles at an opposite end, within a paint can having a top lip, a bottom, and cylindrical side walls having a diameter, the paint can containing a quantity of paint having a paint level, comprising:

an outer ring, the outer ring round and substantially similar in diameter to the paint can diameter, the outer ring defining a large central opening, the outer ring for extending within the paint can with the outer ring in close proximity to the side walls and substantially at the paint level wherein the outer ring includes an outer surface, an inner surface, and a bottom, the outer surface and inner surface meet at a peak and define a cavity which is open at the bottom; and a support surface attached to the outer ring and spanning across the large central opening, the support surface made of a mesh material for allowing the bristles of the paintbrush to rest upon the support surface while the bristles are in communication with the quantity of paint through the support surface and while the handle rests against the top lip of the can.

4. The paintbrush support as recited in claim 3, wherein the outer ring is slightly smaller in diameter than the side wall diameter, allowing the outer ring to float upon the quantity of paint, thereby maintaining the outer ring at the paint level.

5. The paintbrush support as recited in claim 4, wherein the support surface extends convex downwardly between and beneath the outer ring so that it dips into the quantity of paint.

* * * * *